US005938062A

United States Patent [19]

Paramski

[11] Patent Number: 5,938,062

[45] Date of Patent: Aug. 17, 1999

[54] FOOD DISPENSING PACKAGE

[76] Inventor: Walter P. Paramski, 31401 N. O Plain Rd., Libertyville, Ill. 60048

[21] Appl. No.: 08/941,926

[22] Filed: Oct. 1, 1997

[51] Int. Cl.[6] ..... B65D 41/32; B65D 51/18; B65D 88/42

[52] U.S. Cl. ..... 220/254; 220/222; 220/227; 220/266

[58] Field of Search ..... 220/254, 216, 220/219, 221, 227, 265, 266, 268, 276, 345, 378, 578, 580, 217, 222, 224

[56] References Cited

U.S. PATENT DOCUMENTS

| | | | |
|---|---|---|---|
| D. 276,118 | 10/1984 | Conti et al. . | |
| 593,333 | 11/1897 | Park . | |
| 1,973,449 | 9/1934 | Tighe, Jr. . | |
| 2,147,771 | 2/1939 | Hathaway | 220/227 X |
| 2,812,121 | 11/1957 | Sheets . | |
| 3,578,467 | 5/1971 | Huber | 220/227 X |
| 4,456,143 | 6/1984 | Davis et al. | 220/219 X |
| 4,682,705 | 7/1987 | Hurwitz . | |
| 4,819,829 | 4/1989 | Rosten et al. | 220/254 X |
| 4,934,570 | 6/1990 | Bamberger et al. . | |
| 5,086,941 | 2/1992 | English et al. | 220/254 |
| 5,219,091 | 6/1993 | Paramski . | |
| 5,249,692 | 10/1993 | Gunderson . | |
| 5,328,045 | 7/1994 | Yoshida . | |
| 5,370,260 | 12/1994 | Paramski . | |
| 5,402,908 | 4/1995 | Warden et al. . | |
| 5,415,312 | 5/1995 | Mueller . | |
| 5,692,635 | 12/1997 | Farrell et al. | 220/276 X |

*Primary Examiner*—Stephen Castellano
*Assistant Examiner*—Niki M. Eloshway
*Attorney, Agent, or Firm*—Pauley Petersen Kinne & Fejer

[57] ABSTRACT

A food dispensing package having a container and a dispensing cover. The dispensing cover having a lid with a through hole to allow passage of a food product from within the container as the dispensing cover is pushed into the container. A closure element is removably attached with respect to the lid so that in a closed position the closure element covers the through hole and in an open position the closure element exposes the through hole. A flexible gasket portion that is mateable with a sidewall of the container is formed around the perimeter of the lid. A rim that is engageable with an upper portion of the sidewall is positioned about a periphery of the lid and removably attached with respect to the lid.

8 Claims, 3 Drawing Sheets

FOOD DISPENSING PACKAGE

BACKGROUND OF THE INVENTION

1. Field of the Invention

This invention relates to a food dispensing package for dispensing food wherein a dispensing cover of the food dispensing package, after separation from a rim of the dispensing cover, is forced toward a bottom of the container which provides an indication of the food remaining in the container and forces food upward through a resealable through hole in the cover.

2. Description of the Prior Art

Many food containers exist which hold fluidized food, such as various dips for chips, vegetables and the like. However, most conventional food containers require the user to scoop the food out with a utensil, such as a spoon, knife or the like. Other containers for food have various covers or lids for preserving the food during storage. Many covers or lids are purchased separately from the food package and must be retroactively added to the food package container. Some conventional lids are for the purpose of retaining heat or preventing the spillage of the fluidized food.

For example, Mueller, U.S. Pat. No. 5,415,312, discloses a cold beverage container having a lid with a hinged resealable stopper that covers a drinking hole in the lid. Likewise, Yoshida, U.S. Pat. No. 5,328,045, discloses a container cover having an openable film closure.

Sheets, U.S. Pat. No. 2,812,121, teaches a dispensing container for liquids, powder, sugar and the like. The protective cover for the container has a flange with a cut away section. By squeezing or applying pressure about the periphery of the container, the container extends in a predetermined direction to form a spout through which liquid within the container can be poured. The spout extends through the cut away section of the lid when the container is compressed about its periphery.

Tighe, U.S. Pat. No. 1,973,449, and Conti, U.S. Pat. No. Des. 276,118, disclose different covers for dishes or the like. According to the teachings of the Tighe patent, the cover has openings for the exhaust of steam or vapor.

Paramski, U.S. Pat. No. 5,219,091 and Paramski, U.S. Pat. No. 5,370,260 teach dispensing food containers comprising a cover having a through hole. As the cover is pushed into a food container, fluidized product is discharged through the through hole in the cover.

It is thus apparent that there exists a need for a resealable cover and container which are distributed in a single saleable unit and provide easy dispensing, and complete coverage, of a fluidized food container, such as for dips for vegetables, chips, crackers and the like, particularly without requiring additional utensils for dispensing the food or separate containers for storing the food.

SUMMARY OF THE INVENTION

It is one object of this invention to provide a container for dispensing food wherein a cover can be displaced from the top of the container to the bottom of the container while maintaining a seal between the food product and the ambient air.

It is another object of this invention to provide a container for dispensing food that permits closure of a through hole for maintaining a seal between the food product and the ambient air.

It is still another object of this invention to provide a container for dispensing food wherein a cover that achieves the above objects is available as a component of the container for dispensing food and the food product in a unitary package at the point of purchase.

It is yet another object of this invention to provide a container for dispensing food that provides an indication of the food product remaining in the container upon immediate visual inspection.

These and other objects of this invention are accomplished in a food dispensing package that preferably comprises a container and a dispensing cover. The dispensing cover preferably comprises a lid having a through hole, a closure element, a flexible gasket portion and a rim.

The food dispensing package according to this invention preferably is distributed sealed and wrapped to prevent spoilage of the food product. When the food dispensing container according to one preferred embodiment of this invention is in use, food product inside the food dispensing package is immediately accessible and yet the food dispensing package is immediately resealable.

The lid is preferably configured with the through hole generally along a perimeter of the lid. The through hole allows fluidized food to pass from the container through the through hole in the lid.

In one preferred embodiment of this invention, the closure element is removably attached with respect to the lid. The closure element is preferably configured to allow scooping and spreading of the food product found in food dispensing package. In a closed position, the closure element covers at least one through hole and preferably all of the through holes. The closure element is preferably connected with respect to the lid so that fluidized food does not escape from the through hole when the closure element is in the closed position. In an open position, the closure element is preferably at least partially removed from the lid and exposes at least one through hole.

The flexible gasket portion is preferably formed around at least a portion of a perimeter of the lid. The flexible gasket portion may be constructed from a low density polymer, such as rubber, or any other material having appropriate flexibility to permit close contact between the lid and the container.

The rim is preferably positioned about a periphery of the lid and removably attached with respect to the lid. In a fully assembled package, the rim preferably mates with an upper portion of a sidewall of the container which upper portion preferably forms a lip that is mateable with a channel of the rim. In one preferred embodiment of this invention, a tear strip is formed between the flexible gasket portion and the rim. The tear strip preferably tears in a predetermined pattern, such as a circular pattern, preferably around the perimeter of the dispensing cover.

In another preferred embodiment of this invention, the rim is removably attached to the lid. In this preferred embodiment, the flexible gasket portion is internal to the food dispensing package when the food dispensing package is fully assembled and ready for sale.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

Food dispensing package 5 according to one preferred embodiment of this invention is used to distribute a food product, preferably a fluidized food product such as sour cream, cottage cheese, chip dip, pudding or other food products with similar consistency. Such food product typically has a short shelf life and is subject to spoilage if not held within a sealed container.

Figure 1A:
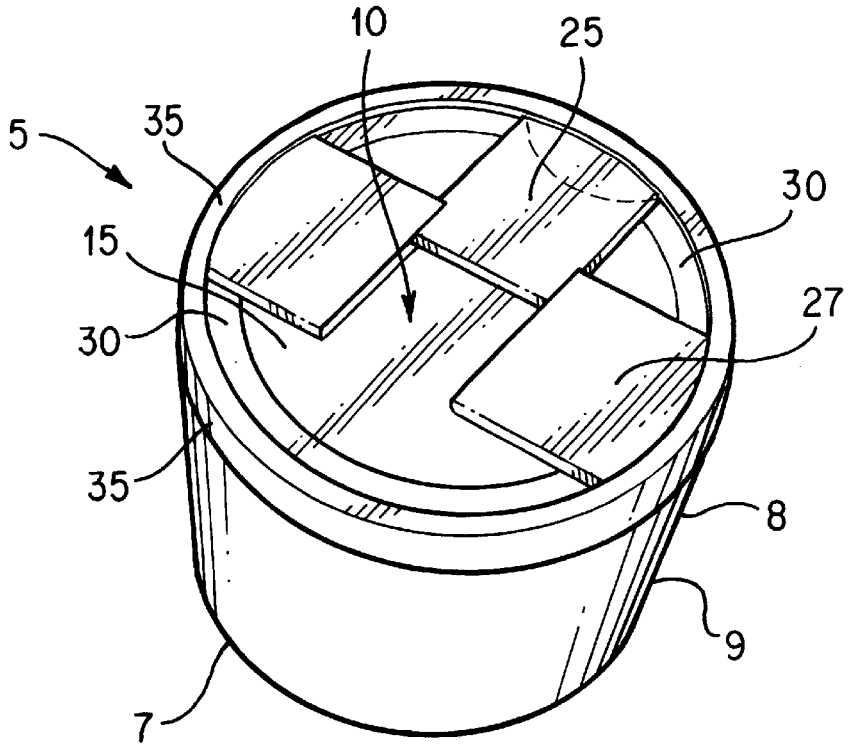
FIG. 1A is a perspective view of a food dispensing container in an assembled condition according to one preferred embodiment of this invention.
Figure 1B:
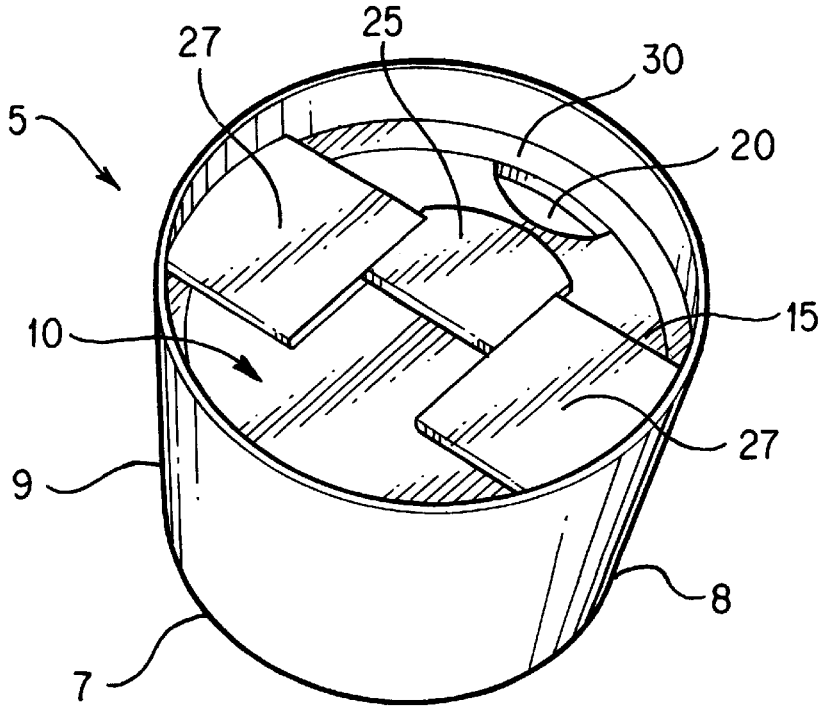
FIG. 1B is a perspective view of a food dispensing container in use according to one preferred embodiment of this invention.

FIGS. 1A and 1B shows food dispensing package 5 in two different conditions. FIG. 1A shows food dispensing package 5 in an assembled condition according to one preferred embodiment of this invention. The "assembled condition" is defined as the condition of food dispensing package 5 at the point of purchase by a consumer. This means that food dispensing package 5 is sealed and wrapped to prevent spoilage of the food product.

FIG. 1B shows food dispensing package 5 in use according to one preferred embodiment of this invention. "In use" is defined as the condition after food dispensing package 5 is opened and the food product inside food dispensing package 5 is immediately accessible.

As shown in FIGS. 1A and 1B, food dispensing package 5 preferably comprises container 8 and dispensing cover 10. Although shown in FIGS. 1A and 1B as round, container 8 may have a cross-section of any suitable shape for fluidized food such as rectangular, oval or polygonal. Likewise, although FIGS. 1A and 1B show container 8 as tapered, sidewall 9 may be straight vertical so that container 8 forms a cylinder. A perimeter of dispensing cover 10 is preferably configured in a similar manner to a top edge of sidewall 9 of container 8.

Figure 2:
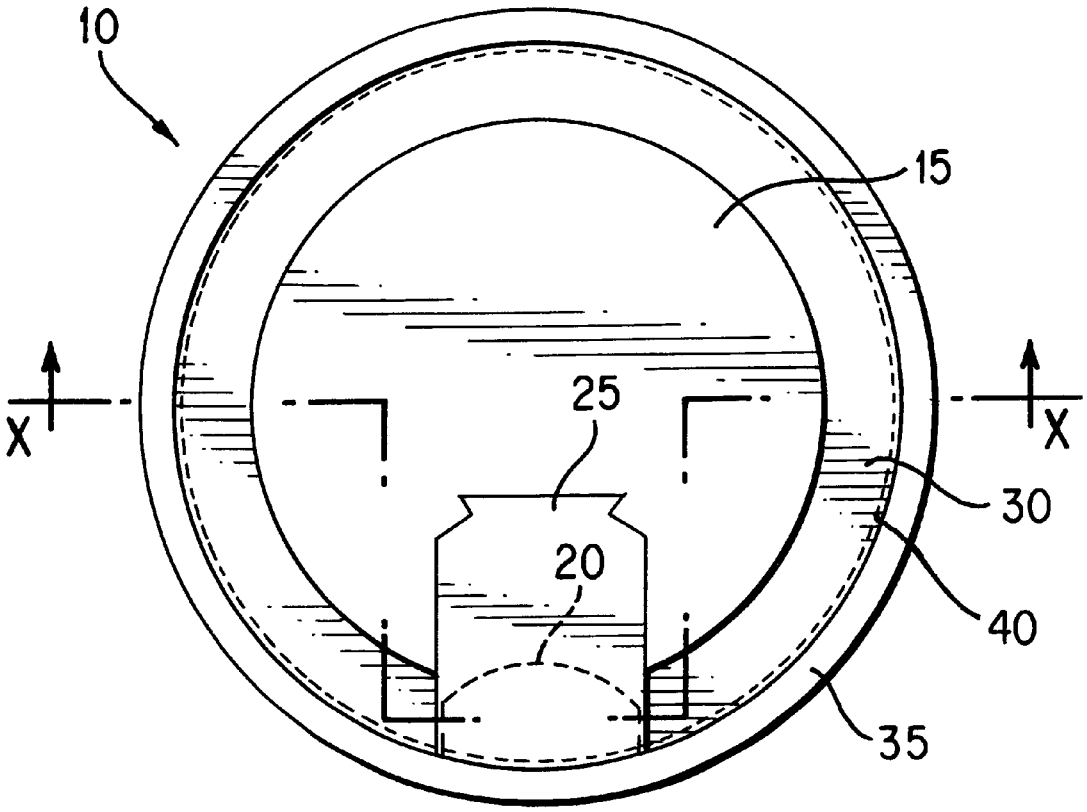
FIG. 2 is a top view of a cover according to one preferred embodiment of this invention.
Figure 3:
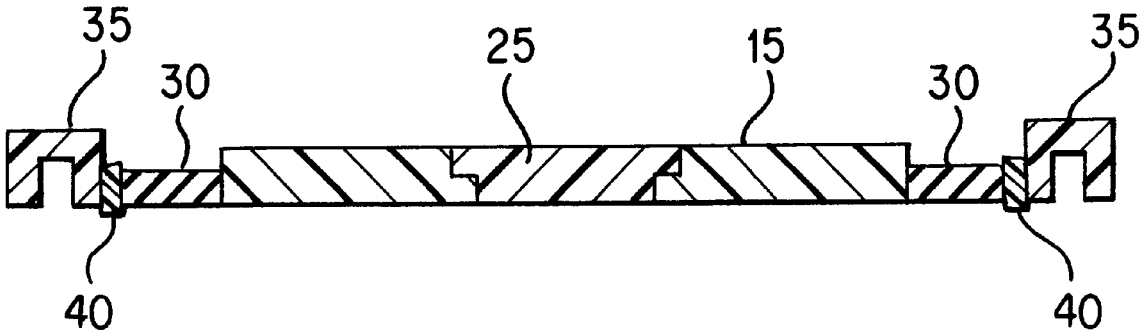
FIG. 3 is a cross-sectional view, taken along line X—X of the cover as shown in FIG. 2.
Figure 4A:
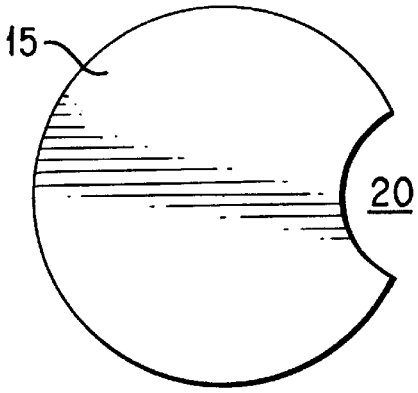
FIGS. 4A–4F each show a top view of a lid of this invention, each according to one preferred embodiment.
Figure 4B:
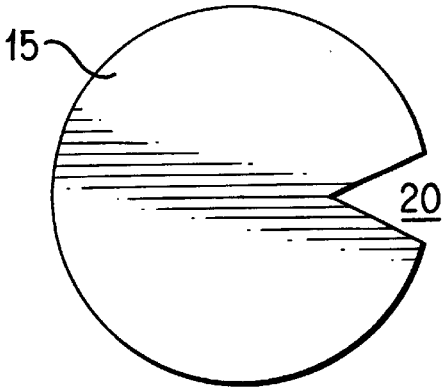
Figure 4C:
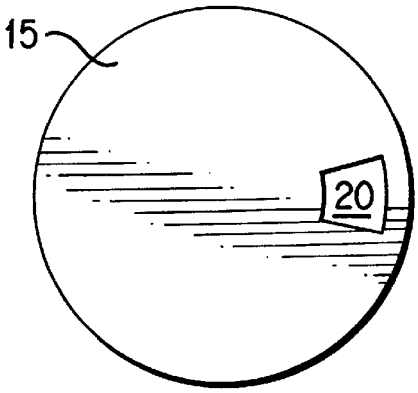
Figure 4D:
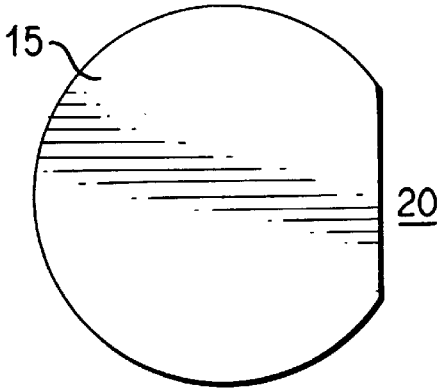
Figure 4E:
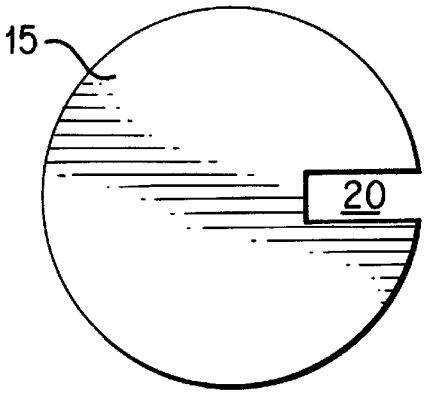
Figure 4F:
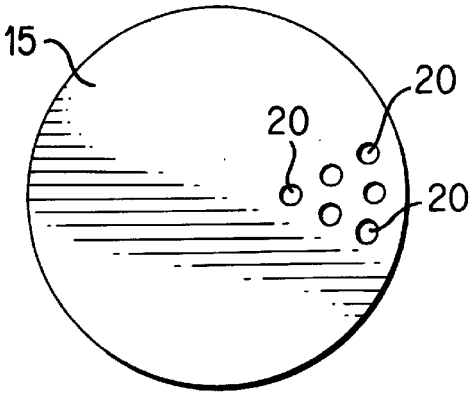

As shown in FIGS. 2 and 3, dispensing cover 10 preferably comprises lid 15 with through hole 20, closure element 25, flexible gasket portion 30 and rim 35. In one preferred embodiment of this invention, an upper surface of dispensing cover 10 is generally planar to accommodate stacking multiple food dispensing packages 5. A lower surface of dispensing cover 10 is also preferably generally planar to facilitate close contact between dispensing cover 10 and food product in container 8.

In one preferred embodiment of this invention, as shown in FIGS. 1–4A, lid 15 is configured with a semi-circular through hole 20 along a perimeter of lid 15. FIGS. 4B–4F show various other embodiments of the possible configurations for through hole 20. It is apparent that other suitably shaped through holes 20 can be used at various positions about lid 15 to accomplish the same result of this invention, allowing food product to pass from food dispensing package 5 through through hole 20 in lid 15.

Closure element 25 is removably attached with respect to lid 15. In an open position, closure element 25 is preferably at least partially removed from lid 15 and exposes at least one through hole 20. In one preferred embodiment of this invention, closure element 25 is completely removed from lid 15 and used to scoop and/or spread food product from through hole 20. Closure element 25 is preferably configured to allow scooping and/or spreading of food product found in food dispensing package 5. In one preferred embodiment of food dispensing package 5 shown in FIGS. 1A and 1B, closure element 25 is a flat, generally rectangular component having a semi-circular end portion. Such a semi-circular end portion permits the closure element 25 to closely mate with inner portion of sidewall 9 of container 8. Also, when closure element 25 is detached from food dispensing package 5, closure element 25 provides a convenient scooper and/or spreader for food product, such as sour cream.

In a closed position, closure element 25 covers at least one through hole 20. Closure element 25 is preferably connected with respect to lid 15 so that fluidized food does not escape from through hole 20 when closure element 25 is in the closed position. In a preferred embodiment of this invention, closure element 25 maintains a virtually airtight connection with through hole 20 so that fluidized food is not exposed to ambient air, thus accelerating possible spoilage of fluidized food.

In one preferred embodiment of this invention, shown in FIGS. 1A and 1B, closure element 25 slides through tracks 27 connected with respect to lid 15. A bottom surface of closure element 25 may be coated with a material (not shown) to maintain a seal between closure element 25 and lid 15. In another preferred embodiment of this invention, shown in FIG. 3, closure element 25 may have a portion that snaps into lid 15 and/or through hole 20.

Flexible gasket portion 30 is preferably formed around at least a portion of a perimeter of lid 15. Flexible gasket portion 30 may be constructed from a low density polymer, such as rubber, or any other material having appropriate flexibility to permit close contact between lid 15 and container 8. Flexible gasket portion 30 preferably creates a seal between dispensing cover 10 and container 8. Such a seal prevents spoilage of food product within food dispensing package 5.

Flexible gasket portion 30 is preferably sized to an appropriate diameter so that the seal between the dispensing cover 10 and container 8 can be maintained from the position of dispensing cover 10 when food dispensing package 5 is first opened to the position of dispensing cover 10 when container 8 is completely empty and dispensing cover 10 is flush with bottom 7 of container 8. Therefore, in container 8 having a circular cross-section such as container 8 shown in FIGS. 1A and 1B, as the taper of sidewall 9 increases the relative diameter of flexible gasket portion 30 must also increase.

In one preferred embodiment of this invention, rim 35 is removably attached with respect to food dispensing package 5. Rim 35 is preferably positioned about a periphery of lid 15 and removably attached with respect to lid 15. In an assembled condition, rim 35 preferably forms a channel, or some other mateable connection known to those having ordinary skill in the art. Rim 35 preferably mates with an upper portion of sidewall 9 which upper portion preferably forms a lip that is mateable with the channel of rim 35.

In one preferred embodiment of dispensing cover 10, tear strip 40, as represented in FIGS. 2 and 3, is formed between flexible gasket portion 30 and rim 35. Tear strip 40 may be plastic or other suitable material which tears in a predetermined pattern, such as a circular pattern as shown in FIG. 2. Tear strip 40 preferably separates from flexible gasket portion 30 but may, in one preferred embodiment of this invention, remain attached to rim 35 after separation from flexible gasket portion 30.

In another preferred embodiment of this invention, rim 35 is removably attached to lid 15. In this preferred embodiment, flexible gasket portion 30 is preferably internal to food dispensing package 5 when food dispensing package 5 is in the assembled condition.

When rim 35 is separated from dispensing cover 10, with tear strip 40 or other preferred means, rim 35 may be removed and discarded. Dispensing cover 10 alone provides adequate area and strength to seal food dispensing package 5 such that food product does not leak or spoil.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

We claim:

1. A dispensing cover for covering a container of fluidized food product, the dispensing cover comprising:

a lid, the lid having at least one through hole extending radially inwardly from a perimeter of the lid;

a closure element being attached to said lid and movable between a closed position and an open position, wherein said closure element covers said at least one through hole in said closed position and exposes said at least one through hole in said open position;

a flexible gasket portion formed around at least a portion of the perimeter of the lid, a diameter of the flexible gasket portion sized to maintain a seal between the flexible gasket portion and a tapered sidewall of the container as the lid moves between a top of the container and a bottom of the container; and a rim removably attached to a radially outer edge of said gasket, said rim having an inverted U shape, wherein removal of said rim allows said lid to move between the top of the container and the bottom of the container.

2. The dispensing cover of claim 1 wherein a tear strip is formed between the lid and the rim.

3. The dispensing cover of claim 1 wherein the rim is removably attached to the flexible gasket portion.

4. The dispensing cover of claim 1 wherein a tear strip is formed between the rim and the flexible gasket portion.

5. The dispensing cover of claim 1 wherein a tear strip is formed between the lid and the rim.

6. The dispensing cover of claim 1 wherein the rim is removably attached to the flexible gasket portion.

7. The dispensing cover of claim 1 wherein a tear strip is formed between the rim and the flexible gasket portion.

8. A food dispensing package comprising:

a container of fluidized food product having a bottom surface, a container top and a tapered sidewall;

a lid, the lid having at least one through hole extending radially inwardly from a perimeter of the lid;

a closure element being attached to said lid and movable between a closed position and an open position, wherein said closure element covers said at least one through hole in said closed position and exposes said at least one through hole in said open position;

a flexible gasket portion mateable with said tapered sidewall of the container and formed around at least a portion of the perimeter of the lid, a diameter of the flexible gasket portion sized to maintain a seal between the flexible gasket portion and said tapered sidewall of the container as said lid moves between said container top and said bottom surface of the container; and a rim removably attached to a radially outer edge of said gasket, said rim having an inverted U shape, wherein removal of said rim allows said lid to move between said container top and said bottom surface of the container.

* * * * *